US007822323B2

(12) United States Patent
Sugiyama et al.

(10) Patent No.: US 7,822,323 B2
(45) Date of Patent: Oct. 26, 2010

(54) FAN

(75) Inventors: Tomotsugu Sugiyama, Kyoto (JP); Shinji Tekemoto, Kyoto (JP); Satoru Hanaoka, Kyoto (JP)

(73) Assignee: Nidec Corporation, Kyoto (JP)

( * ) Notice: Subject to any disclaimer, the term of this patent is extended or adjusted under 35 U.S.C. 154(b) by 664 days.

(21) Appl. No.: 11/752,980

(22) Filed: May 24, 2007

(65) Prior Publication Data

US 2007/0280840 A1 Dec. 6, 2007

(30) Foreign Application Priority Data

May 31, 2006 (JP) ..... 2006-151764

(51) Int. Cl.
*B23K 1/005* (2006.01)

(52) U.S. Cl. ..... 392/410; 417/354; 439/577

(58) Field of Classification Search ..... None
See application file for complete search history.

(56) References Cited

U.S. PATENT DOCUMENTS

| | | | | |
|---|---|---|---|---|
| 2,926,838 | A * | 3/1960 | Van Rijn | 417/354 |
| 3,644,066 | A * | 2/1972 | Heob et al. | 417/354 |
| 4,098,547 | A * | 7/1978 | Wrobel | 439/527 |
| 4,160,576 | A | 7/1979 | Vettori | |
| 4,636,669 | A * | 1/1987 | Plunkett et al. | 310/51 |
| 4,773,828 | A * | 9/1988 | Hagiwara et al. | 417/354 |
| 5,189,327 | A * | 2/1993 | Ootsuka et al. | 310/71 |
| 5,452,181 | A * | 9/1995 | Hoover | 361/697 |
| 6,190,197 | B1 * | 2/2001 | Polgar et al. | 439/527 |
| 6,431,910 | B1 * | 8/2002 | Chuang et al. | 439/577 |

FOREIGN PATENT DOCUMENTS

| | | |
|---|---|---|
| JP | 63-134197 | 9/1998 |
| JP | 2000-303998 | 10/2000 |

OTHER PUBLICATIONS

First Office Action issued by SIPO on Feb. 13, 2009 in related application No. 20071015468.7 and its English translation.

* cited by examiner

*Primary Examiner*—Thor S Campbell
(74) *Attorney, Agent, or Firm*—Volentine & Whitt, PLLC

(57) ABSTRACT

Fan includes wires electrically connected to the circuit board outwardly extends from a base toward a housing along a rib connecting the base supporting a motor and the housing. The housing includes a wire-receiving section defined by a through hole extending in the housing, and a slit connecting the through hole and an outside of the housing along a direction in which the through hole extends. The wires are inserted into the wire-receiving section via the slit, and then, led outside of the housing through the wire-receiving section. A wire-holding member is then inserted into the wire-receiving section to close the slit to prevent the wires from coming out of the wire-receiving section and to restrict the movement of the wires.

16 Claims, 10 Drawing Sheets

FAN

BACKGROUND OF THE INVENTION

1. Field of the Invention

The present invention generally relates to a fan, more particularly relates to a fan having a structure firmly holding a lead wire.

2. Description of the Related Art

Recently, fans are used for various applications. For example, an electronic device may have a cooling fan to dissipate heat to an outside of the casing of the electronic device. A copying machine may include a suction fan to feed papers.

Generally, the fan includes a motor which has a rotor and a stator, an impeller which has a plurality of blades arranged around the rotor, and a housing which radially surrounds the impeller, a base supporting the motor in the housing. The fan also includes wires to supply electricity to the motor, and the wires extend from a circuit board arranged in the fan to an outside of the housing. Recently, dimensions of the electronic devices are getting smaller and smaller. Correspondingly, an available space to arrange electronic components and/or the fan is getting smaller and smaller.

Conventionally, the wires extend from the circuit board into a radially outside direction and cross a passage of air flow defined by an inner surface of the housing. The wires led to the housing are received in a wire-receiving section of the housing before being led out of the housing of the fan. In the conventional fan, the wires are not firmly held on the housing, and therefore, the wires may go slack and be lifted from an end surface of the housing when an external force is applied thereto. In some case, the wire may come out of the wire-receiving section. When the fan is installed to the electronic device, the slack wire or the wire coming away from the wire-receiving section may get caught with other electronic components, which may result in damaging the other electronic components and/or breaking the wire. Therefore, the wire should be firmly held, otherwise the slack wire may be an obstacle to installing the fan into the electronic device or may cause damage to the electronic device.

Conventionally, a part of the wires are housed in the wire-receiving section, and a bushing member is attached to the wire-receiving section to press the wires against the housing to hold the wires, such that the wires do not protrude from the end surface of the housing. In the conventional fan, the bushing member is attached to the wire guiding groove to make a gap between the bushing and a part of the housing defining the wire-receiving section narrower than outer diameters of the wires so as to pinch the wires therebetween. However, an excessive force may be applied to the wires, resulting in damaging or breaking the wires.

SUMMARY OF THE INVENTION

In order to overcome the problems described above, preferred embodiments of the present invention provide a fan including an impeller centered on a center axis, a motor operable to rotate the impeller to generate an air-flow, a wire electrically connected to the motor to provide electricity to the motor, a base supporting the motor, a housing including an inner surface surrounding the impeller and defining a passage of the air flow, and a wire-receiving section defined by a through hole through which the wire is led outside the housing, a rib connecting the base and the housing, and a wire-holding member at least a part of which is inserted in the wire-receiving section along a depth direction of the through hole.

Preferred embodiments of the present invention also provides a fan including an impeller centered on a center axis, a motor operable to rotate the impeller to generate an air-flow, a wire electrically connecting the motor and an external power supply to provide electricity to the motor, a base supporting the motor, a housing, a rib connecting the base and the housing, and a wire-holding member. The housing includes a cylindrical portion having an inner surface surrounding the impeller and defining a passage of air flow, and a square portion arranged at axially end portion of the cylindrical portion and having a substantially square shape whose side length is substantially the same as an outer diameter of the cylindrical portion, the square portion has a circular opening defining an air inlet or an air outlet of the passage of the air flow, and. The housing also includes a wire-receiving section having an indent portion at which the part of the side of the square portion is indented, and an extending portion at which a part of the housing protrudes in the wire-receiving portion along the side of the square portion, a tip end of the extending portion faces another part of the housing via a gap defined therebetween. The wire-holding member is attached to the housing to close the gap between the extending portion and the part of the housing.

Preferred embodiments of the present invention also provides a fan including an impeller centered on a center axis, a motor operable to rotate the impeller to generate an air-flow, a wire electrically connecting the motor and an external power supply to provide electricity to the motor, a base supporting the motor, a housing, a rib connecting the base and the housing, and a wire-holding member. The housing includes a cylindrical portion having an inner surface surrounding the impeller and defining a passage of air flow, and a square portion arranged at axially end portion of the cylindrical portion and having a substantially square shape whose side length is substantially the same as an outer diameter of the cylindrical portion, the square portion has a circular opening defining an air inlet or an air outlet of the passage of the air flow. The housing also includes a wire-receiving section having an indent portion at which the part of the axial portion axially is indented, and an extending portion at which a part of the housing protrudes in the wire-receiving portion along an axial end surface of the axial end portion, a tip end of the extending portion faces another part of the housing via a gap defined therebetween. The wire-holding member is attached to the housing to close the gap between the extending portion and the part of the housing.

According to the preferred embodiments of the present invention, the wire is inserted into the wire-receiving section through the gap defined between the tip end of the extending portion and the part of the housing. Then, the gap is closed by attaching the wire-holding member to the wire-receiving section, and thus, the wire does not come out via the gap.

Other features, elements, advantages and characteristics of the present invention will become more apparent from the following detailed description of preferred embodiments thereof with reference to the attached drawings.

DETAILED DESCRIPTION OF THE PREFERRED EMBODIMENT

Figure 1:
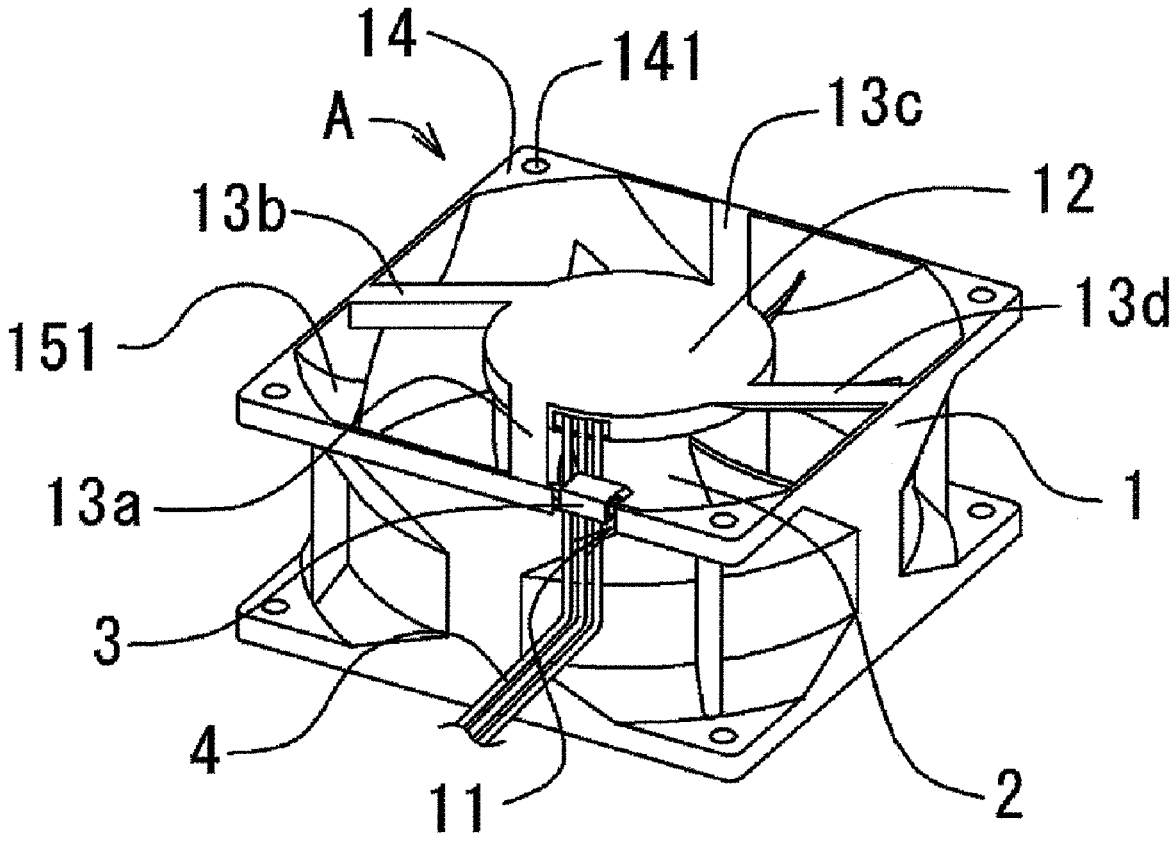
FIG. 1 is a perspective view illustrating a fan according to a first preferred embodiment of the present invention.

With reference to FIGS. 1 through 10, preferred embodiments of the present invention will be described in detail. It should be understood that in the description of the preferred embodiments of the present invention, when positional relationships among and orientations of the different components are described as being such as upper/lower, inner/outer, top/bottom or left/right, positional relationships and orientations that are in the drawings are indicated, and positional relationships among and orientations of the components once having been assembled into an actual device are not indicated. Meanwhile, in the following description, an axial direction indicates a direction parallel to a rotation axis of a fan, and a radial direction indicates a direction perpendicular to the rotation axis.

First Preferred Embodiment

Figure 2:
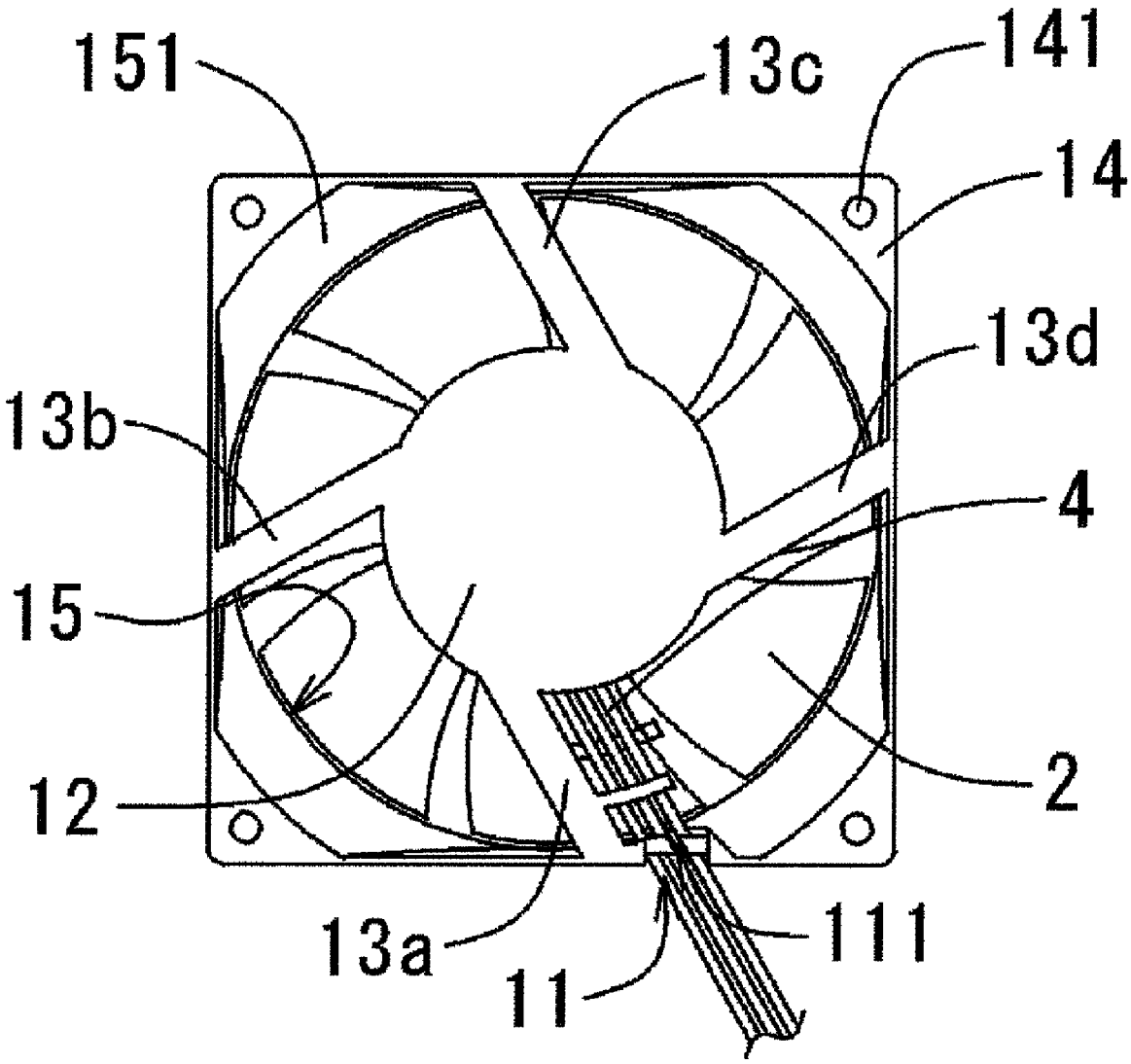
FIG. 2 is a perspective view illustrating a fan according to the first preferred embodiment of the present invention without a wire holding member to be attached to the fan.

With reference to FIGS. 1 through 7, a first preferred embodiment of the present invention will be described in detail. FIG. 1 is a perspective view illustrating a fan according to the first preferred embodiment of the present invention. FIG. 2 is a perspective view illustrating the fan without a wire holding member being inserted into a wire-receiving section.

Figure 3:
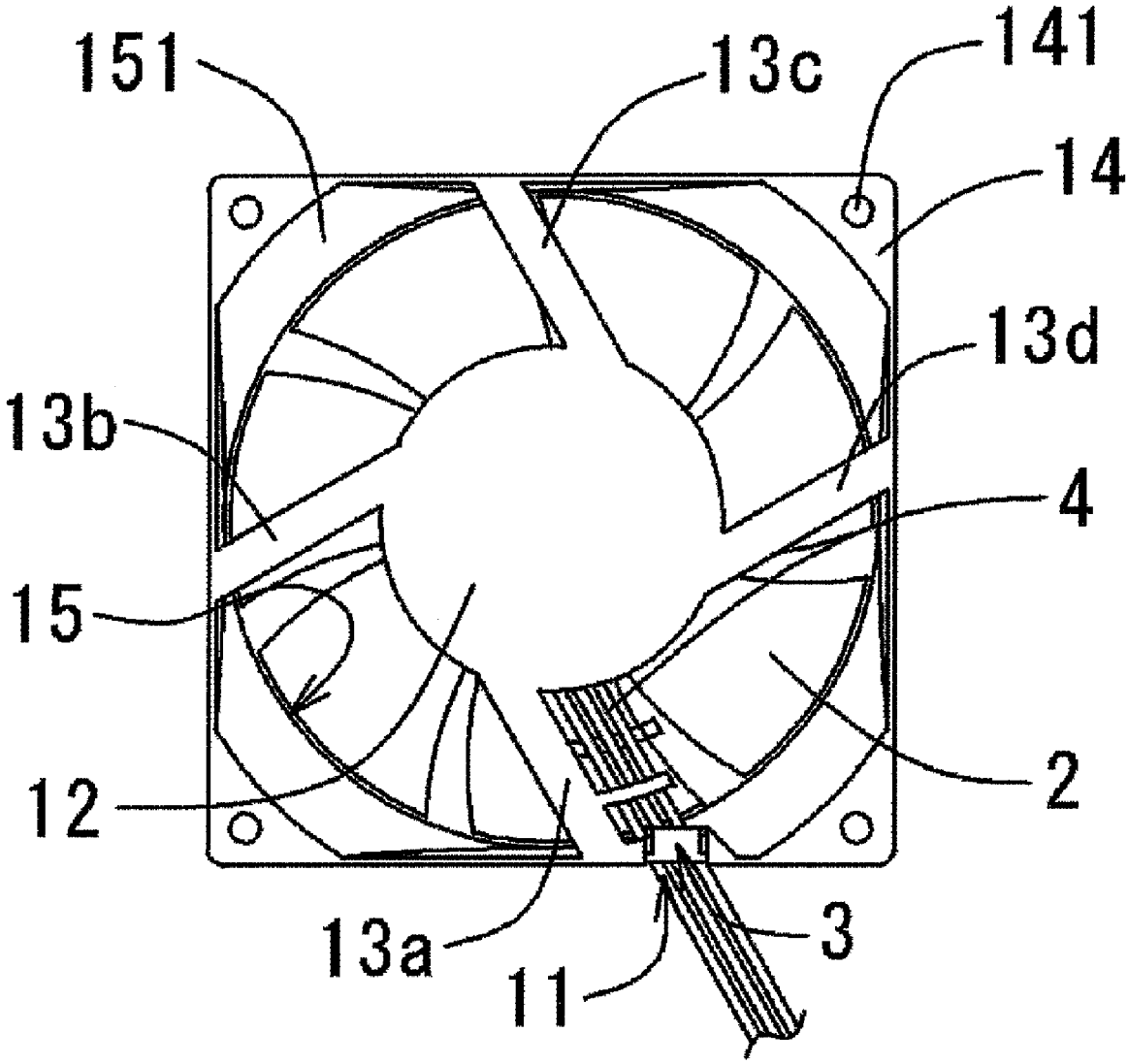
FIG. 3 is a plan view illustrating a fan according to the first preferred embodiment of the present invention.
Figure 4:
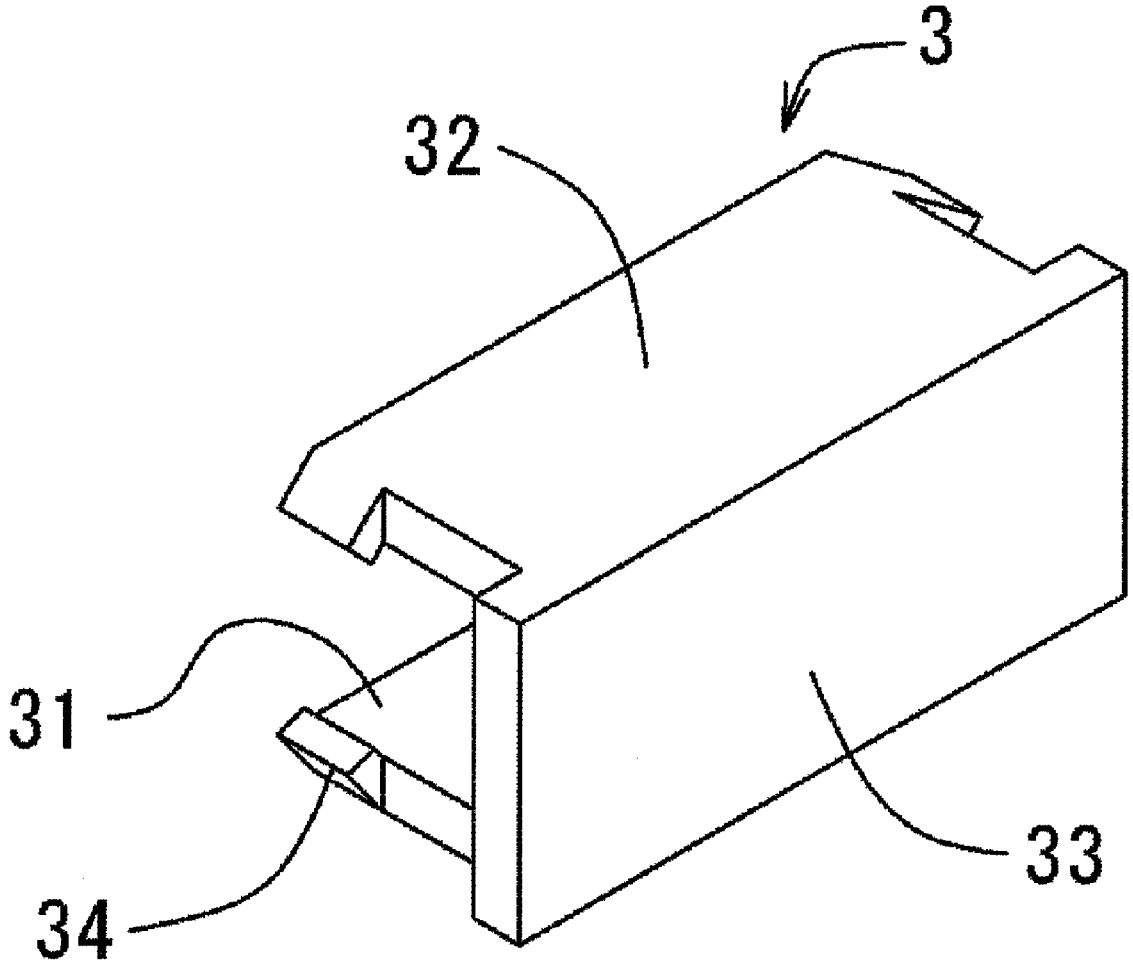
FIG. 4 is a perspective view illustrating a wire-holding member according to the first preferred embodiment of the present invention.
Figure 5:
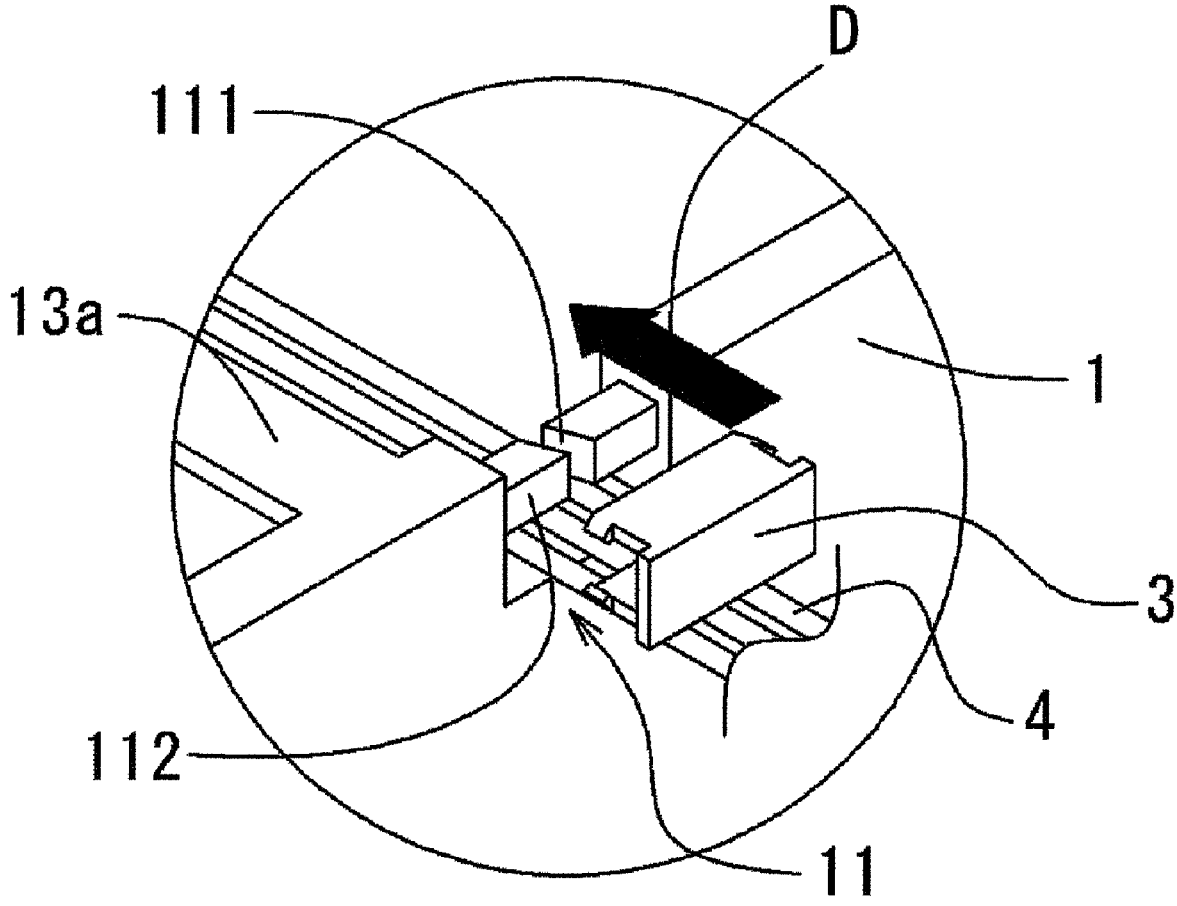
FIG. 5 is a schematic drawing illustrating a wire-receiving section arranged on a housing of a fan and a wire-holding member according to the first preferred embodiment of the present invention to be inserted into the wire-receiving section.
Figure 6:
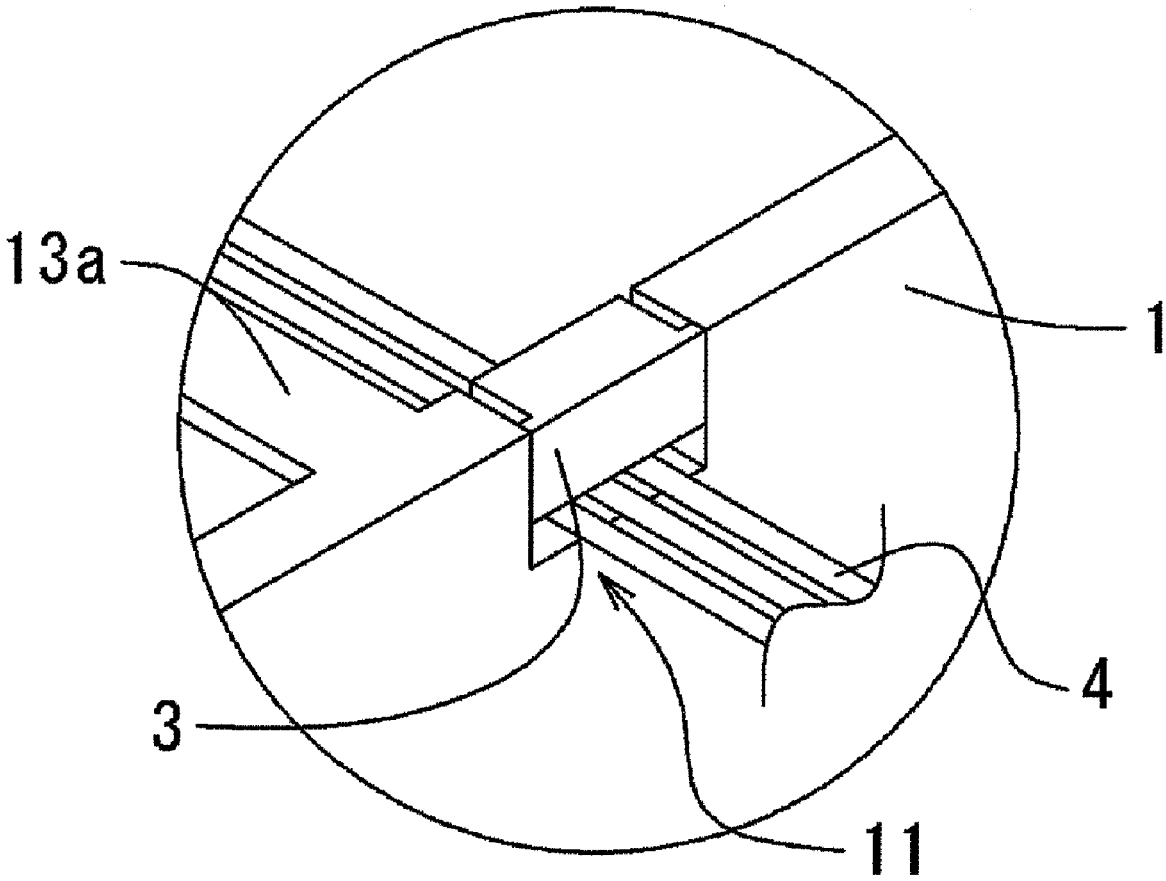
FIG. 6 is a schematic drawing illustrating a wire-receiving section of a housing and a wire-holding member according to the first preferred embodiment of the present invention inserted into the wire-receiving section.
Figure 7:
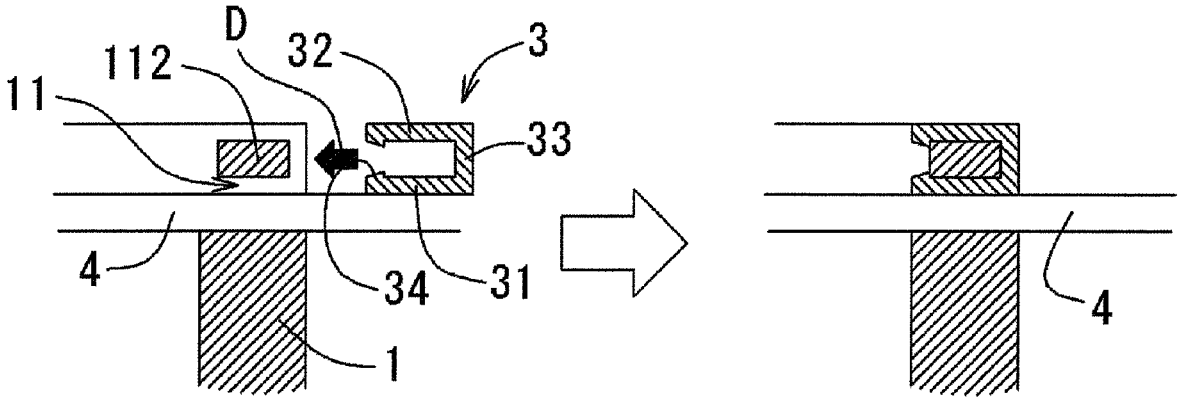
FIG. 7 is a cross sectional view illustrating a wire-receiving section of a housing and a wire-holding member according to the first preferred embodiment of the present invention.

FIG. 3 is a plan view illustrating the fan. FIG. 4 is a perspective view illustrating the wire-holding member. FIG. 5 is a schematic drawing illustrating the wire-receiving section and the wire-holding member which is to be inserted into the wire-receiving section. FIG. 6 is a schematic drawing illustrating the wire-receiving section and the wire-holding member which is inserted into the wire-receiving section. FIG. 7 is a cross sectional view illustrating the wire-receiving section and the wire-holding member.

In the first preferred embodiment of the present invention, a fan A illustrated in FIG. 1 includes a motor (not illustrated in drawings) which has a rotor (not illustrated in drawings) and a stator (not illustrated in Figs), an impeller 2 which has a plurality of blades arranged around the rotor, a housing 1 which radially surrounds the outer circumference of the impeller, and a base supporting the motor in the housing. The stator is arranged on the base 12, and the base 12 is connected to the housing via four ribs 13*a*, 13*b*, 13*c*, and 13*d*. The housing 1 has an inner surface radially surrounding the impeller 2 and defining a passage-of-air-flow 15 generated by the rotation of the impeller 2. An axially end portion of the housing 1 has a substantially square shape on its upper and bottom end portions. In addition, an outer circumference of the housing 1 at its middle portion has a substantially circular shape whose diameter is substantially the same as a side length of the square shape. Therefore, each of the upper and bottom ends includes flange portions 14 protruding radially outwardly at the four corners of the square shape. The flange portions 14 include mounting holes 141 which are used to mount the fan A to an electronic device with screws, for example. The four ribs 13*a*, 13*b*, 13*c*, and 13*d* are arranged in an equally spaced manner in a circumferential direction.

A circuit board (not illustrated in the drawings) is mounted on a base side of the stator, and a plurality of wires 4 are electrically connected to the circuit board. The wires 4 extend toward outside of the housing 1 along a direction in which the rib 13*a* extends (i.e., the radially outward direction). The rib 13*a* radially extends from the base 12 toward the housing 1 to connect the housing 1 and the base 12, and the housing 1 includes the wire-receiving section 11 defined by a through hole penetrating the housing 1 in a depth direction substantially perpendicular to one outer side of the housing, through which the wires 4 are led outside of the housing 1. As illustrated in FIG. 2, the wire receiving section 111 also includes a slit 111 extends axially so as to connect the through hole and outside of the housing 1 along the depth direction of the through hole. The width of the slit 111 is substantially the same as a diameter of one of the wires 4, such that the wires 4 are inserted into the wire-receiving section 11 through the slit 111. As stated above, parts of the wires 4 are inserted into the wire-receiving section 11 from an upper to bottom direction via the slit 111. Without the slit 111, tip ends of the wires 4 have to be inserted into the wire-receiving section 11. In this preferred embodiment of the present invention, the wires 4 may be easily inserted into the wire-receiving section 11 by inserting a middle of the wires 4 into the wire-receiving section 11 via the slit 111.

The width of the slit 111 is just about the size so that a thick lead wire (i.e., about 1.5 mm diameter) may barely pass through. By virtue of the configuration mentioned above, the lead wires 4 may be easily inserted into the wire-receiving section 11 via the slit 111, but do not easily come out of the slit 111. The wires 4 inserted into the wire-receiving section 11 then extend to the outside of the housing 1.

In other point of view, the housing 1 includes a cylindrical portion having the inner surface surrounding the impeller 2 and defining a passage of the air flow 15. At axial end portion of the cylindrical portion, a square portion having a substantially square shape whose side length is substantially the same as an outer diameter of the cylindrical portion is arranged. The square portion has a circular opening defining an air inlet or an air outlet of the passage of the air flow. The wire-receiving section 11 is defined by an indent portion at which a part of the square portion of the housing 1 is axially indented, and an extending portion which is a part of the housing 1 protruding in the indent portion. One tip end of the extending portion faces other part of the housing 1 via a gap defined therebetween, such that the wires 4 are easily inserted in the wire-receiving section 11 but do not easily come out of the wire-receiving section 11. The other part of the housing 1 may be another extending portion protruding another part of the housing 1 in the indent portion, and tip ends of the extending portions may face each other with the gap defined therebetween.

In FIGS. 1, 3, and 6, the fan A having a wire-holding member 3 attached to the wire-receiving section by inserting at least a portion of the wire-holding member 3 into the wire-receiving section 11 is illustrated. As illustrated in FIGS. 1, 3, and 6, the wire-holding member 3 is attached from the radially outside of the housing 1 to the wire-receiving section 11 along the depth direction of the through hole, in which the through hole substantially extends. The direction of inserting the wire-holding member 3, however, is not limited to that just described above. The wire-holding member 3 may be attached from the radially inside of the housing 1 to the wire-receiving section 11 along the depth direction of the through hole. The wire-holding member 3 is attached to the wire-receiving section 11 so as to close the slit 11, preventing the wires 4 from coming out of the wire-receiving section 11. Without the wire holding member 3, the wires 4 may come out of the wire-receiving section 11 through the slit 111 or may go slack and protrude from the upper end surface of the housing 1 when an external force is applied to the wires 4. Such slack in the wires 4 may be an obstacle when the fan A is installed into the electronic device and/or may cause damage to the electronic components of the electronic device. In the present preferred embodiment of the present invention, by inserting the wire-holding member 3 into the wire-receiving section 11 to close the slit 111, it is possible to prevent the above problem from occurring.

Next, the wire holding member 3 will be described in detail. FIG. 5 is a perspective view illustrating the wire holding member 3. The wire holding member 3 is preferably made of a metallic material and is formed by press working. Preferably, a metallic material having an anti-rust property (e.g., a stainless steel material) is used for the wire holding member 3. Meanwhile, the press working is a method of machining a metallic material, in which the metallic material is placed between the dies and pressed by them to apply pressure, such that the shape of the metallic material is changed into a predetermined shape. In the press working, a pressing machine which includes an upper die and a lower die relatively movable for abutting them each other is used for forming the wire-holding member 3. The pressing work generally enables to produce more wire-holding member 3 per unit time comparing with other manufacturing method such as cutting and resin-injection molding, resulting in lowering manufacturing cost of the wire-holding member 3. Thus, in the view of the efficiency of manufacturing, the press working is preferably used in the preferred embodiment of the present invention. The metallic material generally has strength, rigidity, thermostability and workability superior to the resin material. Thus, by the press working, it is possible to form the wire-holding member 3 for the fan A whose outer diameter is small (e.g., 30 mm×30 mm size fan). It should be noted, however, the wire-holding member 3 may be made of the resin material (e.g., polybutylene terephthalate). In this case, the resin-injection molding may be adopted for manufacturing of the wire-holding member 3.

FIG. 4 is a perspective view illustrating the wire-holding member 3. As illustrated in FIG. 4, the wire-holding member 3 includes a wire-restricting portion 31, an outside portion 32, and a connecting portion 33. The wire-restricting portion has a substantially rectangular shape, and the outside portion has the substantially rectangular shape and facing the wire-restricting portion via a space defined therebetween. One side of the wire-restricting and a corresponding side of the outside portion are connected by the connecting portion. Thus, the wire-holding member 3 has a substantially U-shape, as illustrated in FIG. 4. It should be noted, however, the shapes of the wire-restricting portion 31 and the outside portion 32 are not limited to the rectangular shape. The wire-restricting portion 31 and the outside portion 32 may be any shapes as long as the wire-holding member 3 is attached to the wire-receiving section by clamping the extending portion therebetween. The wire-restricting portion 31 is inserted into the wire-receiving section 11 when the wire-holding member 3 is attached to the wire-receiving section 11. An outside portion 32 faces the wire-restricting portion 31 with a space defined therebetween, and a connecting portion 33 connects one ends side of the wire-restricting portion 31 and the outside portion 32. It is preferable to make the wire-restricting portion 31 thinner to make the wire-receiving section smaller as necessary.

The wire-receiving section 11 has an enough space to accommodate the wires 4 with a clearance allowing the wires 4 to be freely movable in a certain degree. By inserting a part of the wire-holding member 3 (i.e., the wire-restricting portion 31) into the wire-receiving section 11 as illustrated in FIG. 5, the clearance is reduced and the movement of the wires 4 in the wire-receiving section 11 is restricted.

As illustrated in FIG. 7, in the present preferred embodiment of the present invention, sum of the axial heights of the wires 4 and the wire-restricting portion 31 is substantially the same as the inner dimension in the axial direction of the wire-receiving section 11. Thus, the clearance is almost filled by inserting the wire-restricting portion 31. When the sum of the axial thicknesses of the wires 4 and the wire-restricting portion 31 is greater than the inner dimension in the axial direction of the wire-receiving section 11, the wire-restricting portion 31 presses the wires 4 against the housing 1. As a result, the excessive pressure may be applied to the wires 4, resulting in breaking or damaging the wires 4. In the present preferred embodiment of the present invention, the excessive pressure is not applied to the wires 4, preventing the wires 4 from being damaged or broken. In addition, since the slit 111 is closed with the wire-holding member 3, it is possible to prevent the wires 4 from coming out of the wire-receiving section 11.

When the wire-holding member 3 is attached to the wire-receiving section 11 along a depth direction D (i.e., the direction in which the through hole of the wire-receiving section extends) illustrated in FIGS. 5 and 7, an extending portion 112, a part of the housing 1 defining an axially upper portion of the wire-receiving section 11 and the slit 111 is formed therein, is clamped between the wire-restricting portion 31 and the outside portion 32. In addition, the wire-holding member 3 includes pawls 34 arranged at tip portions of the wire-restricting portion 31 and the outside portion 32 respectively to be latched to a part of the housing 1 and/or the extending portion 112. Through the configuration, the wire-holding member 3 is firmly attached to the wire-receiving section 11.

In the present preferred embodiment of the present invention, the wire-holding member 3 is made of metallic material, and due to the elasticity of the metallic material, the pressure that the wire-restricting portion 31 and the outside portion 32 apply to the extending portion 112 is adjusted by changing the shape of the wire-holding member 3 or composition of the material. Additionally, since the shapes of the wire-receiving section 11 and the wire-holding member 3 are simply, machining of them is facilitated.

It is preferable that the outside portion 32 of the wire-holding member 3 does not axially upwardly protrude from the upper end surface of the housing 1 and the connecting portion 33 does not radially outwardly protrude from the side surface of the housing 1 when the wire-holding member 3 is attached to the wire-receiving section 11. In the present preferred embodiment of the present invention, a concave portion, at which a part of the housing 1 is inwardly indented at and around the wire-receiving section 11, is arranged on the housing 1 as illustrated in FIG. 5. The depth of the concave portion is greater than the thickness of the outside portion 32 and the connecting portion 33, and thus, as illustrated in FIG. 6, the outside portion 32 and the connecting portion 33 are housed in the concave portion and do not protrude from the housing 1 when the wire-holding member 3 is attached to the wire-receiving section 11.

In addition, it is preferable that the wire-holding member 3 does not protrude into the passage-of-air-flow 15 (see FIG. 2). When the wire-holding member 3 protrudes into the passage-of-air-flow 15, air flow generated by rotating the impeller 2 interacts with the wire-holding member 3 and the windage loss increases. Thus, it results in the reduction of the flow rate and the increase of the noise. In order to prevent the problems, the shapes of the wire-restricting portion 31 and the outside portion 32 of the wire-holding member 3 are configured such that they do not protrude into the passage-of-air-flow 15 when wire-holding member 3 is inserted into the wire-receiving section 11 (i.e., the lengths of the wire-restricting portion 31 and the outside portion 32 along the depth direction D is shorter than the thickness in the depth direction D of the housing 1).

The outer shape of the axially both ends surface of the housing 1 is a substantially square shape. The inner surface of the housing 1 defines the passage-of-air-flow 15 having a substantially column shape centered on a center axis of the square shape. The passage-of-air-flow 15 is in addition defined with four corner portions 151 which are arranged at around corners of the square shape and at which the passage-of air-flow 15 gradually expands in the radial direction along the axially outward of the housing 1. Each of the ribs 13*a*, 13*b*, 13*c*, and 13*d* extends toward outside of the housing 1 and connected to the housing 1 at a portion other than the corner portion 151. When each of the ribs 13*a*, 13*b*, 13*c*, and 13*d* is connected to the housing 1 at the corner portion 151, a length of each of ribs 13*a* to 13*d* becomes longer since the passage-of air-flow 15 gradually expands at each of the corner portion 151. With the longer ribs, an area of the passage-of-air-flow 15 where the ribs prevent the smooth air flow increases.

The housing 1, the base 12, and the ribs 13*a* to 13*d* are formed integral by resin injection molding. In the resin injection molding, two molds are relatively moved along a predetermined direction to abut them and define the cavity therebetween. Then, the melted resin is injected into the cavity. Finally, two molds are relatively moved along the predetermined direction to separate the molds, and the resin molded product is obtained. Thus, a blind spot of the resin molded product when viewed along the predetermined direction is not processed by the resin injection molding, in general. In the present preferred embodiment of the present invention, there are blind spots axially between the corner portion 151 of the housing 1 and the ribs 13*a* to 13*d* when viewed along the axial direction, corresponding to the predetermined direction of the molds movement, resulting in forming unnecessary molded portions at the blind spots. When the ribs 13*a* to 13*d* are connected to the housing 1 at the four corner portions 151 respectively, greater unnecessary molded portions are formed between ribs 13*a* to 13*d* and parts of the housing 1 defining the corner portions 151. The greater unnecessary molded portions are arranged in the passage-of-air-flow 15, the greater windage loss becomes. In the present preferred embodiment of the present invention, the blind spots between the housing 1 and the ribs 13*a* to 13*d* are reduced by connecting the ribs 13*a* to 13*d* to the housing 1 at portions other than the corner portions 151. Through the configuration, the unnecessary molded portion is reduced, reducing of the windage loss.

The wires 4 are led outside of the housing 1 along the rib 13*a*. In other words, the wire-receiving section 11 is arranged adjacent to a portion at which the rib 13*a* is connected to the housing 1. As illustrated in FIG. 3, the outer shape of the housing 1 is the substantially square shape, and the rib 13*a* is connected to a middle portion of one side of the housing 1. The wire-receiving section 11 is arranged between the inner surface and the outer side surface of the housing 1, and thus does not protrude into the passage-of-air-flow 15. The thickness of the housing 1 between the inner circumferential surface and the outer side surface becomes thinner at the substantially middle portion of the side of the housing 1. Thus, it is preferable that the wire-receiving section 11 and the wire-holding member 3 are small enough to fit between the inner circumferential surface and the outer side surface. In the preferred embodiment of the present invention, the wire-holding member 3 is inserted and secured to the wire-receiving section 11 by a simple mechanism, latching the pawls 34 to the extending portion 112, enabling to downsize the wire-receiving section 11 and the wire-holding member 3.

Second Preferred Embodiment

Figure 8:
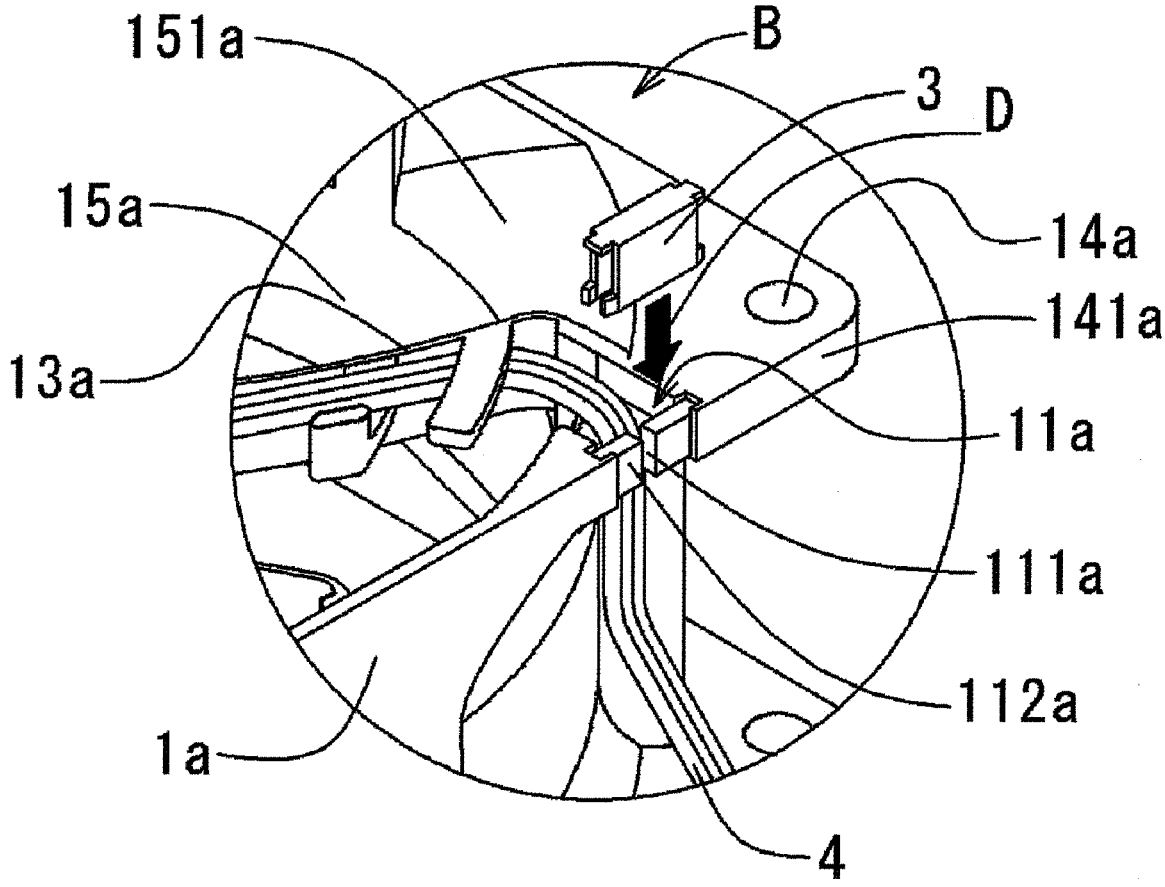
FIG. 8 is a perspective view illustrating a wire-receiving section and a wire-holding member according to a second preferred embodiment of the present invention, to be inserted into the wire-receiving section.
Figure 9:
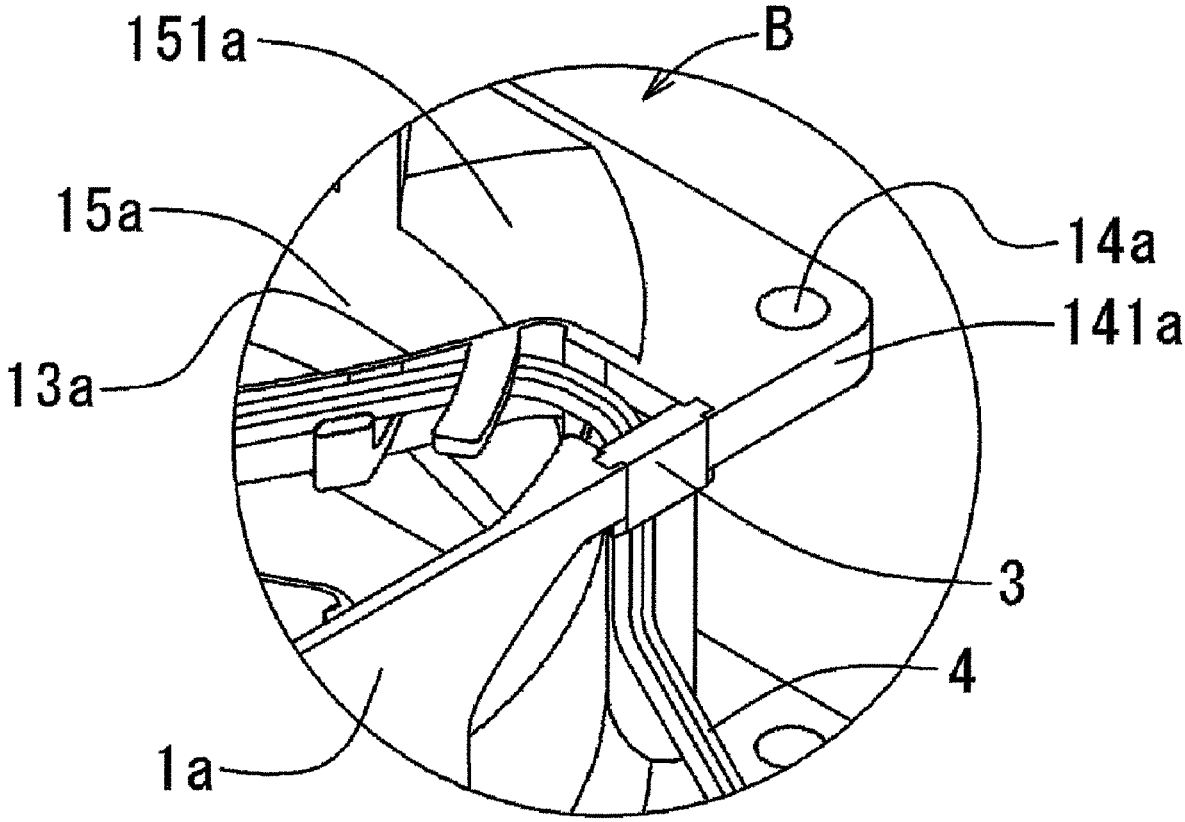
FIG. 9 is a perspective view illustrating a wire-receiving section and a wire-holding member according to a second preferred embodiment of the present invention, inserted into the wire-receiving section.
Figure 10:
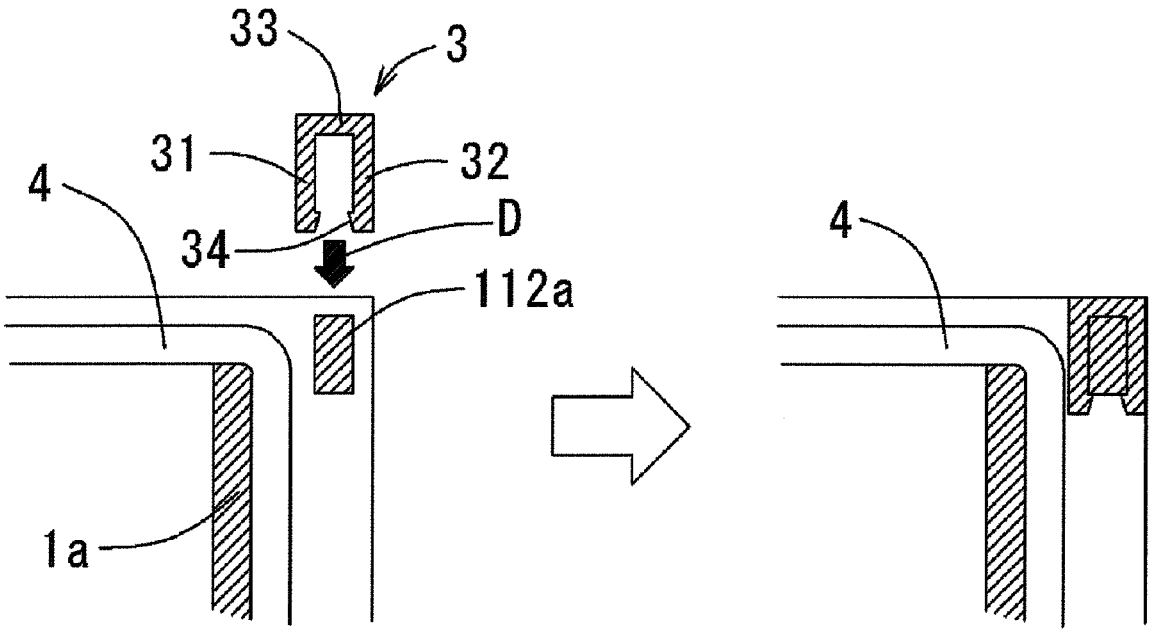
FIG. 10 is a cross sectional view illustrating a wire-receiving section of a housing and a wire-holding member according to the second preferred embodiment of the present invention.

FIG. 8 is a perspective view illustrating a wire-receiving section and a wire-holding member according to a second preferred embodiment of the present invention, to be inserted into the wire-receiving section. FIG. 9 is a perspective view illustrating the wire-receiving section and the wire-holding member according to the second preferred embodiment of the present invention, inserted into the wire-receiving section. FIG. 10 is a cross sectional view illustrating the wire-receiving section of a housing and the wire-holding member according to the second preferred embodiment of the present invention. A fan according to the second preferred embodiment of the present invention has the wire-receiving section and the wire-holding member different in their shapes from those described in the first preferred embodiment of the present invention. The rest of the configuration is substantially the same as that illustrated in the first preferred embodiment of the present invention and is labeled with the same reference characters in the description that follows.

A circuit board (not illustrated in the drawings) is mounted on a base side of the stator, and a plurality of wires 4 are electrically connected to the circuit board. The wires 4 extend toward outside of the housing 1 along a direction in which the rib 13*a* extends (i.e., the radially outward direction). The rib 13*a* extends from the base 12 toward the housing 1*a* to connect a housing 1*a* and the base 12, and the housing 1*a* includes the wire-receiving section 11*a* defined by a through hole penetrating the housing 1 in the depth direction, through which the wires 4 are led outside of the housing 1. As illustrated in FIG. 8, the wire receiving section 111*a* also includes a slit 111*a* radially extends so as to connect the through hole and outside of the housing 1*a*. The width of the slit 111*a* is substantially the same as a diameter of one of the wires 4, such that the wires 4 are inserted into the wire-receiving section 11*a* through the slit 111*a*. Without the slit 111, tip ends of the wires 4 have to be inserted into the wire-receiving section 11. In this preferred embodiment of the present invention, however, the wires 4 may be easily inserted into the wire-receiving section 11*a* by inserting a middle of the wires 4 into the wire-receiving section 11*a* via the slit 111*a*.

The width of the slit 111*a* is just about the size so that a thick lead wire (i.e., about 1.5 mm diameter) may barely pass through. By virtue of the configuration mentioned above, the lead wires 4 may be easily inserted into the wire-receiving section 11*a* via the slit 111*a*, but do not easily come out of the slit 111*a*. The wires 4 inserted into the wire-receiving section 11*a* then extend to the outside of the housing 1*a*. In the second preferred embodiment of the present invention, since a portion of the wire-receiving section 11*a*, in which the wires 4 are inserted, extends into the axial direction, the wires 4 led along the radial direction are bent into the axial direction and inserted into the wire-receiving section as illustrated in FIG. 8.

In other point of view, the housing 1*a* includes a cylindrical portion having the inner surface surrounding the impeller 2 and defining a passage of the air flow 15. At axial end portion of the cylindrical portion, a square portion having a substantially square shape whose side length is substantially the same as an outer diameter of the cylindrical portion is arranged. The square portion has a circular opening defining an air inlet or an air outlet of the passage of the air flow. The wire receiving section 11*a* is defined by an indent portion at which one side of the square portion of the housing 1*a* is inwardly indented, and an extending portion which is a part of the housing 1*a* protruding in the indent portion along the side of the square portion. One tip end of the extending portion faces other part of the housing 1*a* via a gap defined therebetween, such that the wires 4 are easily inserted in the wire-receiving section 11*a* but do not easily come out of the wire-receiving section 11*a*. The other part of the housing 1*a* may be another extending portion protruding another part of the housing 1*a* in the indent portion, and tip ends of the extending portions may face each other with the gap defined therebetween.

A fan B including the wire-receiving section 11*a* and the wire-holding member 3 attached to the wire-receiving section 11*a* by inserting at least a portion of the wire-holding member 3 is illustrated in FIGS. 9 and 10. The wire-holding member 3 is attached to the wire-receiving section 11*a* from the axially outside of the housing 1*a* along the depth direction D in which the through hole substantially extends (i.e., the axial direction in the second preferred embodiment of the present invention). The direction of inserting the wire-holding member 3, however, is not limited to that just described above.

Without the wire holding member 3, the wires 4 may come out of the wire-receiving section 11*a* via the slit 111*a* or may go slack and protrude from the upper end surface of the housing 1*a*, when an external force is applied to the wires 4. Such slack in the wires 4 may be an obstacle when the fan B is installed into the electronic device and/or may cause damage to the electronic components of the electronic device. In the present preferred embodiment of the present invention, by inserting the wire-holding member 3 into the wire-receiving section 11*a* to close the slit 111*a*, it is possible to prevent the above problem from occurring. In the second preferred embodiment of the present invention, since the external force applied to a portion of the wires 4 arranged outside of the housing 1*a* is dispersed at a portion the wires 4 are bent, the external force is not directly applied to parts of the wires 4 extending in a passage-of-air-flow 15*a*.

Same as the configuration described in the first preferred embodiment of the present invention, the wire-holding member 3 includes the wire-restricting portion 31, the outside portion 32, and the connecting portion 33. The wire-restricting portion 31 is inserted into the wire-receiving section 11 when the wire-holding member 3 is attached to the wire-receiving section 11. The outside portion 32 faces the wire-restricting portion 31 via a space defined therebetween, and a connecting portion 33 connects the wire-restricting portion 31 and the outside portion 32. Through the configuration, the wire-holding member 3 is formed into a substantially U-shape. It is preferable to make the wire-restricting portion 31 thinner to make the wire-receiving section smaller as necessary.

The wire-receiving section 11*a* has an enough space to accommodate the wires 4 with a clearance allowing the wires 4 to be freely movable in a certain degree. By inserting a part of the wire-holding member 3 (i.e., the wire-restricting portion 31) into the wire-receiving section 11*a* as illustrated in FIG. 8, the clearance is reduced and the movement of the wires 4 in the wire-receiving section 11*a* is restricted.

As illustrated in FIG. 10, in the present preferred embodiment of the present invention, sum of the radial thicknesses of the wires 4 and the wire-restricting portion 31 is substantially the same as the inner dimension in the radial direction of the wire-receiving section 11*a*. Thus, the clearance is filled by inserting the wire-restricting portion 31. When the sum of the radial thickness of the wires 4 and the wire-restricting portion 31 is greater than the inner dimension in the axial direction of the wire-receiving section 11*a*, the wire-restricting portion 31 presses the wires 4 against the housing 1*a*. As a result, the excessive pressure may be applied to the wires 4, resulting in breaking or damaging the wires 4. In the present preferred embodiment of the present invention, the excessive pressure is not applied to the wires 4, preventing the wires 4 from being damaged or broken. In addition, since the slit 111*a* is closed with the wire-holding member 3, it is possible to prevent the wires 4 from coming out of the wire-receiving section 11*a*.

When the wire-holding member 3 is attached to the wire-receiving section 11*a* along the depth direction D in which the through hole extends (i.e., the axial direction), the extending portion 112*a*, defining a radially outer portion of the wire-receiving section 11*a* and the slit 111*a* is formed therein, is clamped between the wire-restricting portion 31 and the outside portion 32.

Likewise the first preferred embodiment of the present invention, the wire-holding member 3 is made of metallic material so as to give the elasticity to the wire-holding member 3, which is adjustable by changing the shape of the wire-holding member 3 or composition of the material. In addition, the wire-holding member 3 includes pawls 34 arranged at tip portions of the wire-restricting portion 31 and the outside portion 32 respectively. When the wire-holding member 3 is axially attached to the wire-receiving section 11*a*, the wire-restricting portion 31 and the outside portion 32 clamp the extending portion 112*a* and the pawls 34 are latched to the part of the housing 1*a* and/or the extending portion 112. Through the configuration, it is possible to downsize the wire-receiving section 11*a* and the wire-holding member 3. Additionally, since the shapes of the wire-receiving section 11*a* and the wire-holding member 3 are simply, machining of them is facilitated.

It is preferable that the outside portion 32 of the wire-holding member 3 does not axially upwardly protrude from the upper end surface of the housing 1 and the connecting portion 33 does not radially outwardly protrude from the side surface of the housing 1 when the wire-holding member 3 is attached to the wire-receiving section 11*a*. In the present preferred embodiment of the present invention, a concave portion, at which a part of the housing 1*a* is inwardly indented at and around the wire-receiving section 11*a*, is arranged on the housing 1*a* as illustrated in FIG. 8. The depth of the concave portion is greater than the thickness of the outside portion 32 and the connecting portion 33, and thus, as illustrated in FIG. 9, the outside portion 32 and the connecting portion 33 are housed in the concave portion and do not protrude from the housing 1*a* when the wire-holding member 3 is attached to the wire-receiving section 11*a*.

As illustrated in FIGS. 8 and 9, each of the flange portions 14*a* includes a mounting hole 141*a* used for mounting the fan B to an electronic device with a screw, and the wire-receiving section 11*a* is arranged at one of the flange portion 14*a*. Corner sections 151*a*, at which the passage-of-air-flow 15 gradually expands in the radial direction along the axially outward direction of the housing 1*a*, are arranged radially inside of the flange portions 14*a*, respectively. In some cases, the corner portion 151*a* may be extended to improve air-flow property of the fan B. However, by expanding the corner portion 151*a*, a size of each flange portions 14*a*, in which the wire-receiving section 11*a* is formed, becomes smaller.

In the second preferred embodiment of the present invention, since the wire-receiving section 11*a* extends approximately along the axial direction and the wire-holding member 3 is axially attached to the wire-receiving section 11*a*, the radial thickness of the wire-receiving section 11*a* is smaller comparing with the first preferred embodiment of the present invention. In the present preferred embodiment of the present invention, the wire-holding member 3 is formed by pressing the thin plate-shaped metallic material, making the thickness of the wire-holding member 3 thinner. As a result, it is possible to enlarge the diameter of passage-of-air-flow 15 by enlarging the corner portions 151*a*, improving the air flow property of the fan B.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan comprising:

an impeller centered on a center axis;

a motor operable to rotate the impeller to generate an air-flow;

a wire electrically connected to the motor to provide electricity to the motor;

a base supporting the motor;

a housing including an inner surface surrounding the impeller and defining a passage through which the air-flow generated by the impeller courses, and a wire-receiving section comprising a portion of the housing having an indentation therein, and an extending portion extending substantially across the indentation as spaced from the bottom of the indentation such that a gap in the housing is defined between a surface of the extending portion and a surface of the housing defining the bottom of the indentation, and the wire passes from the motor, in between said surface of the extending portion and said surface of the housing defining the bottom of the indentation, and to an outside of the housing, whereby the wire extends through the gap in the housing to the outside thereof;

a rib connecting the base and the housing; and a wire-holding member at least part of which is received in the wire-receiving section, the wire-holding member covering part of the extending portion of the wire-receiving section, and the wire-holding member being detachably connected to the housing so as to be removable from the wire-receiving section of the housing.

2. The fan as set forth in claim 1, wherein the wire-holding member restricts movement of the wire in the wire-receiving section.

3. The fan as set forth in claim 2, wherein the rib is connected to the inner surface of the housing, and the gap in the housing is disposed close to the location at which the rib is connected to the inner surface of the housing.

4. The fan as set forth in claim 2, wherein the extending portion of the wire-receiving section has a slit extending therethrough open to the gap and open at a surface of the extending portion facing the outside of the housing, the slit is covered and closed off from the outside of the housing by the wire-holding member, and the slit has a width at least substantially equal to the diameter of the wire, whereby the wire can be inserted into the gap via the slit before the wire-holding member is connected to the housing.

5. The fan as set forth in claim 1, wherein the wire-holding member includes a wire-restricting portion extending into the gap in the housing and interposed between the wire and the extending portion of the wire-receiving section, an outside portion facing the outside of the housing, and a connecting portion connecting the wire-restricting portion and the outside portion, and the outside portion and the connecting portion are disposed within the confines of the indentation.

6. The fan as set forth in claim 2, wherein the wire-holding member includes a wire-restricting portion extending into the gap in the housing and interposed between the wire and the extending portion of the wire-receiving section, an outside portion facing the outside of the housing, and a connecting portion connecting the wire-restricting portion and the outside portion.

7. The fan as set forth in claim 6, wherein at least one of the wire-restricting portion and the outside portion of the wire-holding member includes a pawl at a tip portion thereof, and the pawl is latched to the housing.

8. The fan as set forth in claim 2, wherein the entirety of the wire-holding member is disposed radially outwardly of the passage through which the air-flow generated by the impeller courses through the housing.

9. The fan as set forth in claim 2, wherein the wire-holding member is a bent piece of sheet metal.

10. The fan as set forth in claim 2, wherein the wire-holding member contacts the wire and presses the wire against said surface of the housing defining the bottom of the indentation.

11. The fan as set forth in claim 1, wherein the wire-holding member is a clip that is clipped onto the housing.

12. The fan as set forth in claim 11, wherein the wire-holding member includes a wire-restricting portion extending into the gap in the housing, and an outside portion facing the outside of the housing, each of the wire-restricting portion and the outside section has a tip end including a pawl, and the wire-holding member has a resiliency that allows the tip end of the wire-restricting portion and the tip end of the outside portion to be move toward and away from each other such that the respective pawls can hook onto and be released from the housing.

13. The fan as set forth in claim 1, wherein the wire-holding member is a clip that is clipped onto the extending portion of the wire-receiving section of the housing.

14. The fan as set forth in claim 13, wherein the wire-holding member includes a wire-restricting portion extending into the gap in the housing through which the wire passes to the outside of the housing, and an outside portion facing the outside of the housing, each of the wire-restricting portion and the outside portion has a tip end including a pawl, and the wire-holding member has a resiliency that allows the tip end of the wire-restricting portion and the tip end of the outside portion to be moved toward and away from each other such that the respective pawls can hook onto and be released from the extending portion of the wire-receiving section of the housing.

15. The fan as set forth in claim 14, wherein the gap in the housing extends through the housing in the axial direction of the fan, the axial direction being the direction of the center axis.

16. The fan as set forth in claim 14, wherein the gap in the housing extends through the housing in a radial direction of the fan perpendicular to the direction of the center axis.

* * * * *